US012428950B2

(12) United States Patent
Liu et al.

(10) Patent No.: US 12,428,950 B2
(45) Date of Patent: Sep. 30, 2025

(54) SYSTEMS AND METHODS TO DETERMINE THE STEERING OF A BIT

(71) Applicant: Halliburton Energy Services, Inc., Houston, TX (US)

(72) Inventors: Yang Liu, Singapore (SG); Julien Christian Marck, Houston, TX (US); Kaixiao Tian, Singapore (SG); Kennedy J. Kirkhope, Houston, TX (US); Ketan C. Bhaidasna, Houston, TX (US); John R. Hardin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/114,166

(22) Filed: Feb. 24, 2023

(65) Prior Publication Data

US 2024/0287890 A1 Aug. 29, 2024

(51) Int. Cl.

| | |
|---|---|
| ***E21B 47/024*** | (2006.01) |
| ***E21B 7/04*** | (2006.01) |
| ***E21B 44/00*** | (2006.01) |

(52) U.S. Cl.

CPC ..... *E21B 47/024* (2013.01); *E21B 7/04* (2013.01); *E21B 44/00* (2013.01); *E21B 2200/20* (2020.05)

(58) Field of Classification Search

CPC ..... E21B 47/024; E21B 7/04; E21B 44/00; E21B 2200/20

See application file for complete search history.

(56) References Cited

U.S. PATENT DOCUMENTS

| | | | | |
|---|---|---|---|---|
| 2017/0370152 | A1* | 12/2017 | Samuel | E21B 47/12 |
| 2019/0128069 | A1 | 5/2019 | Johnson | |
| 2022/0308256 | A1* | 9/2022 | Alhawi | G06N 3/045 |

FOREIGN PATENT DOCUMENTS

| | | | |
|---|---|---|---|
| CN | 102063541 | B | 11/2012 |

OTHER PUBLICATIONS

International Search Report & Written Opinion in PCT/US2023/014145, mailed Nov. 16, 2023.

(Continued)

*Primary Examiner* — Dany E Akakpo

(74) *Attorney, Agent, or Firm* — DeLizio, Peacock, Lewin & Guerra LLP

(57) ABSTRACT

The disclosed embodiments include systems and methods to determine the steering of a bit. The method includes receiving input parameters associated with a model of a bottomhole assembly having a housing and a shaft that runs through an interior of the housing. The method also includes analyzing the housing as a first beam, and analyzing the shaft as a second beam that is nested within the first beam. The method further includes estimating a force and moment at a contact point between the shaft and the housing, determining a housing deflection based on the force and the moment, determining a shaft deflection at the contact point, and determining whether the shaft deflection is within a threshold of the housing deflection. In response to a determination that the shaft deflection is within the threshold of the housing deflection, the method further includes providing an output indicative of steering of a bit.

20 Claims, 9 Drawing Sheets

(56) References Cited

OTHER PUBLICATIONS

Hong Difeng, et al. "Generalized beam-column for non-continuous rotary steering drilling of bottom-hole assembly", Acta Petrolei Sinica, May 2014, vol. 35, No. 3, pp. 543-550.
Yucai Shi, et al. "A Powerful Build-Up Rate (BUR) Prediction Method for the Static Push-the-Bit Rotary Steerable System (RSS)", Energies, 2020, vol. 13, No. 4847, pp. 1-12.
Heng Wang, et al. "Modeling and analyzing the motion state of bottom hole assembly in highly deviated wells", Journal of Petroleum Science and Engineering, 2018, vol. 170, pp. 763-771.
H. Wang, et al. "Drilling Trajectory Prediction Model for Push-the-bit Rotary Steerable Bottom Hole Assembly", International Journal of Engineering, Transactions B: Applications, Nov. 2017, vol. 30, No. 11, pp. 1800-1806.

* cited by examiner

SYSTEMS AND METHODS TO DETERMINE THE STEERING OF A BIT

BACKGROUND

The present disclosure relates generally to systems and methods to determine the steering of a bit with different bottomhole assemblies (BHAs).

Rotary steering systems (RSS) and mud motors are sometimes used during hydrocarbon drilling operations. The relationship between actuation of steering systems with different bottomhole assembly (BHA) design (mud motor, point-the-bit RSS, and push-the-bit RSS) and the response of the corresponding systems, as well as other aspects of the steering systems during hydrocarbon drilling operations are sometimes analyzed before the corresponding steering systems are deployed downhole. Some analyses treat housing and shaft components of a rotary steering system or mud motor as a single component, thereby oversimplifying the analyses, and creating inaccurate analyses and estimations. Some analyses also ignore interactions between a rotary steering system or mud motor and a surrounding borehole wall, thereby also creating inaccurate analyses and estimations. Further, some analyses also take days to complete, which prolong the duration of the analyses, thereby delaying the implementation and deployment of an analyzed rotary steering system and mud motor steering system. The foregoing also burdens hardware systems on which the analyses are run.

BRIEF DESCRIPTION OF THE DRAWINGS

Illustrative embodiments of the present disclosure are described in detail below with reference to the attached drawing figures, which are incorporated by reference herein, and wherein.

Figure 1A:
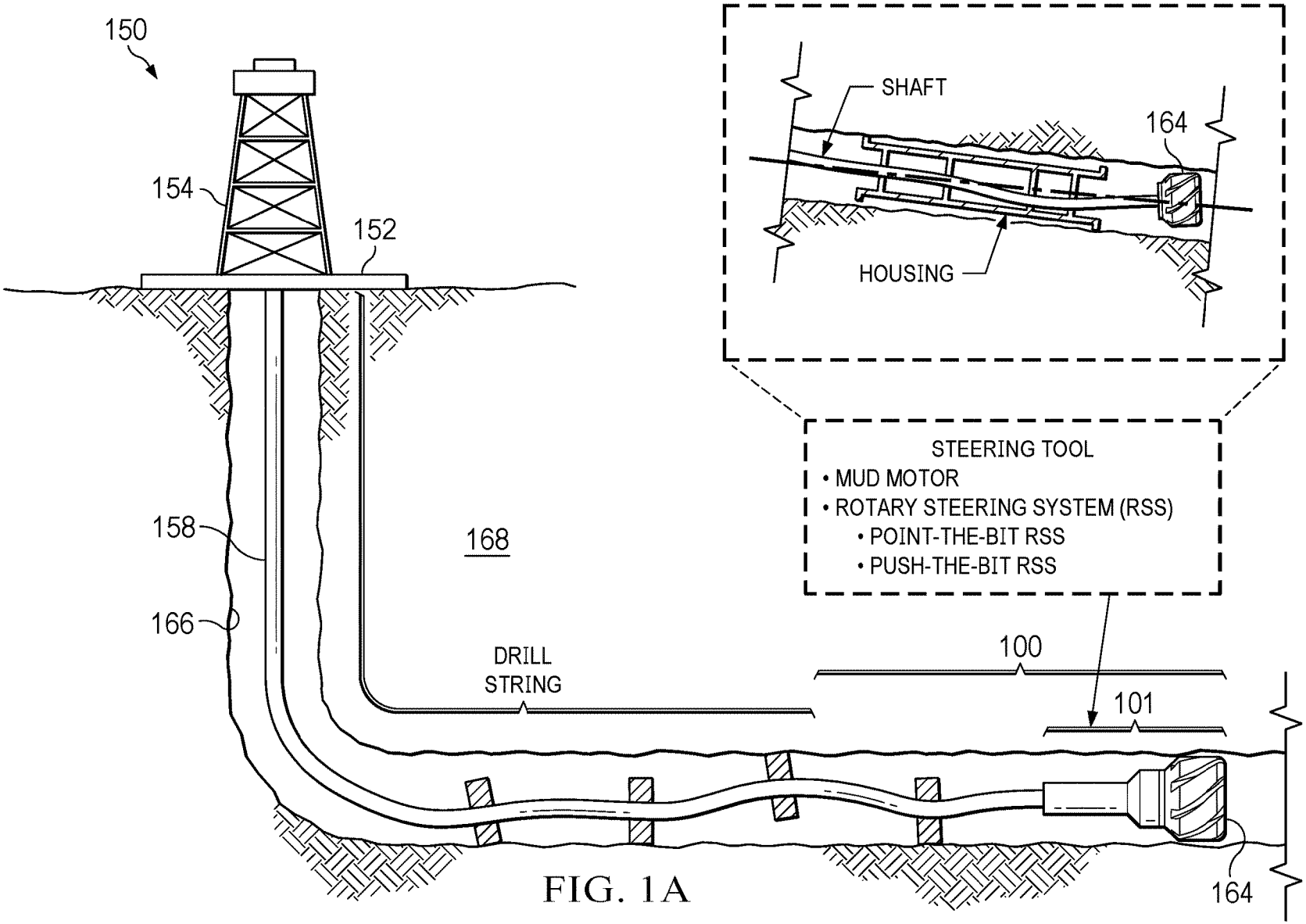
FIG. 1A is a schematic of a drilling system with different bottomhole assemblies (BHAs)

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to systems and methods to determine the steering of the bit with different BHAs. More particularly, the subject technologies described herein utilize a nested beam model to separately analyze a shaft of and a housing of a steering system. Further, the subject technologies described herein treat the housing as a first beam, and treat the shaft (and in some embodiments, a portion of an upper BHA that is coupled to the shaft) as a second beam that is nested within the first beam to determine, model, and analyze the steering tendency. In the context of this disclosure, the term of "steering of the bit" depicts the instantaneous steering direction at the drill bit relative to the borehole from a given BHA design and a specified of work condition including wellbore constraints and loadings (gravity, weight-on-bit and actuation force). A steering tendency of building/dropping of wellbore is defined in a case of inclination angle increase/decrease in a plane, such as a vertical plane, an inclination plane, an azimuth plane, or another plane. The same definition applies in the horizontal plane and the angle change can be defined as a steering tendency of turn-right/turn-left.

A steering direction estimation system receives input parameters (such as, but not limited to the parameters associated with a steering system, parameters associated with a bottomhole assembly the steering system is coupled to, borehole constraints, parameters associated with a drill bit, parameters associated with a drill bit/rock interaction, and parameters associated with other components that are coupled to the bottomhole assembly or the steering system) that are associated with a model of a bottomhole assembly and components that are coupled to the bottomhole assembly (hereafter "BHA model). As referred to herein, a BHA includes a drill bit, a directional steering tool (such as a mud motor or rotary steering system), upper components of the BHA including measuring equipment (MWD and LWD equipment), drill pipes, and subs such as stabilizer and reamers.

The steering direction estimation system discretizes the BHA model to refine the input parameters, and separately analyzes the housing as a beam (first beam), and the shaft as another beam (second beam) that is nested within the first beam. In some embodiments, the steering direction estimation system treats the bit and upper components of BHA that is coupled to the shaft as components of the second beam. In some embodiments, the steering direction estimation system is configured to map (such as via the BHA model) a deflection and inclination at one or more housing-shaft contact points to the corresponding force and moment, and vice versa. The steering direction estimation system estimates the force and moment at one or more contact points between the shaft and the housing, such as at the focal bearing, the eccentric ring, the cantilever bearing, the main bearing, and/or at other contact points between the shaft and the housing. The steering direction estimation system determines the housing deflection and the angle of deflection of the housing based on the force and moment at the contact points. Additional descriptions and illustrations of operations performed by the steering direction estimation system to estimate the force or the moment at the contact points and to determine the housing deflection and the angle of deflection of the housing are provided in the paragraphs below and are illustrated in at least FIG. 5.

In some embodiments, the steering direction estimation system also performs an interaction analysis to determine the configurations of the BHA-wellbore and/or the housing/shaft contacts. As referred to herein, interactions between the BHA and surrounding borehole include any contact between the BHA (including the housing and upper BHA that is coupled to the shaft), and the borehole, which effectively constrains the BHA deformation, and deflection or deformation of the BHA as a result of such contact. In that regard, a configurations of a contact or contact configuration refer to not only the nature of the contact (point or line contact), but also the quantitative parameters associated with the contact, such as the position of the contact along the BHA, and the length of the line contact. In some embodiments, the first beam and/or the second beam may be in contact with borehole at a location other than the bearings. In one or more of such embodiments, the contact is at a point of contact. In one or more of such embodiments, the contact is along a line of contact, where a line contact can be as approximated by a collection of points of contact. A line contact can be treated as a point contact when such a simplification results in negligible differences in the BHA mechanical responses and steering tendency of bit. In some embodiments, certain point contacts are associated with a clearance. In some embodiments, when two objects are in contact at a point, there may or may not exist a reaction force that is pointing away from the contact; when two objects are not in contact, there is strictly no reaction force. The foregoing is referred to herein as a complementarity condition. The collection of such complementarity conditions at each and every contact point effectively constrains the displacements at all the points of contact. Typically, there exist at least one set of displacements such that all the local complementarity conditions are met. In some embodiments, such a set of displacements can be determined by an optimization process described herein.

The steering direction estimation system also determines a shaft deflection and an angle of deflection of the shaft at the contact points, such as at the focal bearing, the eccentric ring, the cantilever bearing, and at the drill shaft. The steering direction estimation system also determines whether the shaft deflection and the housing deflection converge, where the shaft deflection is within a threshold of the housing deflection. In response to a determination that the shaft deflection is within the threshold of the housing deflection, the steering direction estimation system provides an output indicative of the steering tendency.

In some embodiments, and in response to a determination that a convergence has not occurred, where the shaft deflection is not within the threshold housing deflection, the steering direction estimation system modifies one or more input parameters of the BHA model and performs another iteration of the operations described herein to improve and/or optimize the estimations of the housing deflection and shaft deflection. In one or more of such embodiments, the steering direction estimation system performs an optimization operation to reduce a cost function associated with the deflection of the housing and the deflection of the shaft to reduce the variance between the deflection of the housing and the deflection of the shaft. In one or more of such embodiments, the steering direction estimation system is configured to apply various optimization algorithms and/or solving techniques to ensure a convergence that is less than a threshold amount of time so that a compatible set of shaft and housing deflections is achieved. In one or more of such embodiments, the steering direction estimation system is configured to specify and adjust set-ups of the optimization operation, such as apply different optimization algorithms and techniques, tune the algorithm parameters to expedite the converging process, monitor the convergency control the stopping criteria if necessary, etc., to arrive at the desired outcome that the shaft deflection is within the threshold of the housing deflection.

In some embodiments, the input parameters of the BHA model is discretized before calculating the housing deflection. In one or more of such embodiments, by utilizing an analytical model that is discretized to certain number of elements, the number of computations performed to perform the operations described herein is significantly decreased, such that the operations performed herein are completed on the order of seconds to minutes instead of hours to days, thereby reducing the computation time, power, and energy to perform the operations described herein. Although the operations described herein primarily describe applying the subject technology to a point-the-bit rotary steering system, in some embodiments, the subject technologies and operations described herein are also applicable to other systems that utilize a steerable mud motor, a push-the-bit rotary steering system, and other types of steering systems to analyze and model such systems, and to estimate the steering tendency of such systems. Additional descriptions of the foregoing systems and methods to determine steering tendency are described in the paragraphs below and are illustrated in FIGS. 1-5.

Now turning to the figures, FIG. 1A illustrates a schematic of a drilling system 150 having a steering tool 101 that is part of bottomhole assembly 100. It should be noted that while FIG. 1A generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling system 150 may include a drilling platform 152 that supports a derrick 154 having a traveling block (not shown) for raising and lowering a drill string 158. The drill string 158 may include, but is not limited to, drill pipe and coiled tubing, as generally known to those skilled in the art. A kelly (not shown) may support the drill string 158 as it is lowered through a rotary table. The bottomhole assembly 100 may be attached to the distal end of the drill string 158, and the rotary steering system 101 includes a drill bit 164 driven either by a downhole motor and/or via rotation of the drill string 158 from the well surface. The drill bit 164 may include, but is not limited to, roller cone bits, PDC bits, natural diamond bits, any hole openers, reamers, coring bits, etc. As the drill bit 164 rotates, it may create a wellbore 166 that penetrates various 30) subterranean formations 168.

It should be clearly understood that the example system illustrated by FIG. 1A is merely a general application of the principles of this disclosure in practice, and a wide variety of other examples are possible. Therefore, the scope of this disclosure is not limited in any manner to the details of FIG. 1A as described herein.

Figure 1B:
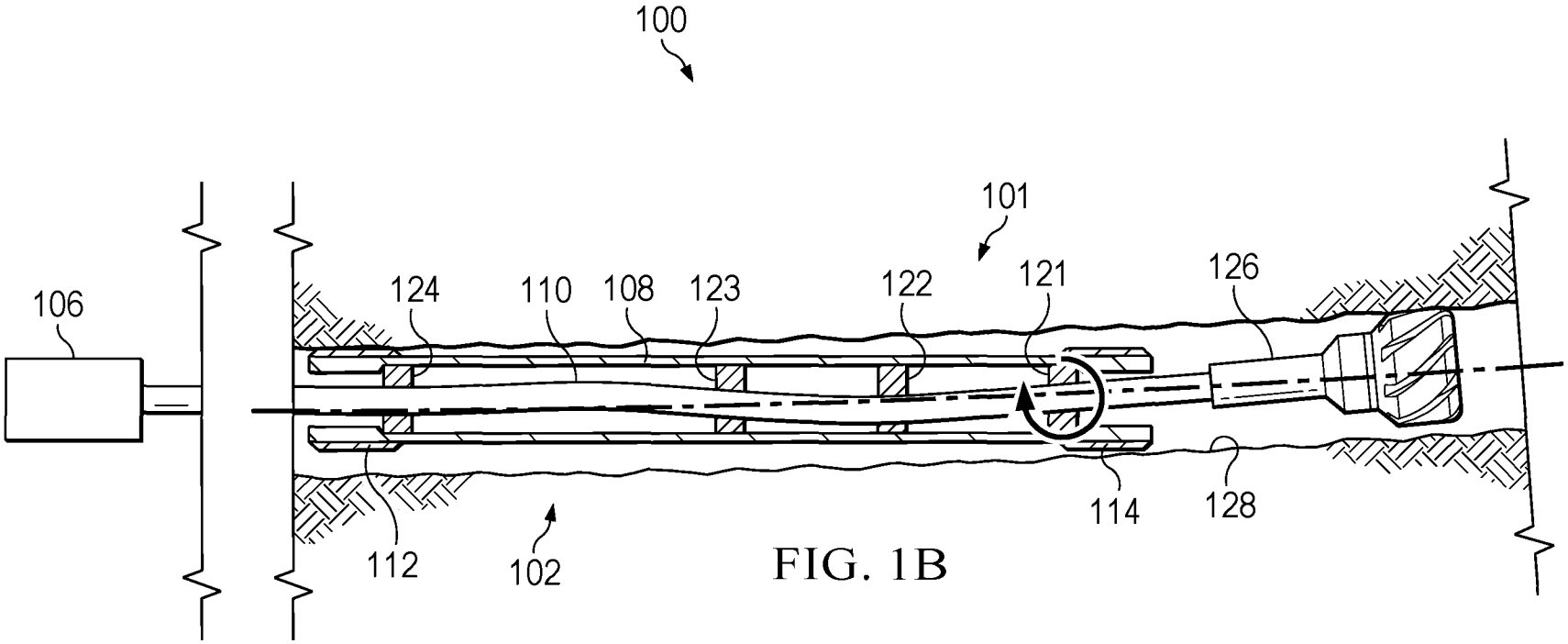
FIG. 1B is a schematic cross-sectional view of steering mechanism components of a point-the-bit rotary steering system.

FIG. 1B is a cross-sectional view of a steering mechanism components of the point-the-bit rotary steering system 101 that is part of bottomhole assembly 100. Bottomhole assembly consists of directional steering tool (mud motor or RSS) 101, measuring equipment (MWD and LWD), drill pipes, subs such as stabilizer and reamers, and drill bit 126. The ability to vary the steering tendency mainly comes from the various design of the directional steering tool (mud motor and rotary steering systems) and the size and displacement of drill pipes and stabilizers. In the embodiment of FIG. 1B, a point-the-bit rotary steering system 101 has a housing 108, and a shaft 110 that runs through an interior of housing 108. Housing 108 has two stabilizers 112 and 114 that are positioned around housing 108 and configured to contact the surrounding borehole 128. Shaft 110 extends through housing 108 and is coupled to a drill bit 126 at lower end of shaft 110. In the embodiment of FIG. 1B, a focal bearing 121, an eccentric ring 122, a cantilever bearing 123, and a main bearing 124 are positioned along the interior of housing 108, and come in physical contact with shaft 110 at different contact points of focal bearing 121, eccentric ring 122, cantilever bearing 123, and main bearing 124. It is understood that the number and placement of bearings vary with different designs and features.

In some embodiments, an intentional deflection of shaft 110 relative to housing 108 at eccentric ring 122 results in shaft 110 pivoting at focal bearing 121 to point drill bit 126 in a desired direction and at a desired tilt angle to create and to control dogleg severity of the wellbore as the wellbore is being drilled. In the embodiment, eccentric ring 122 represents a bi-lateral ramp pushed by hydraulic pump to push driveshaft off center. In some cases, an electric motor can be used to control eccentricity of the eccentric cam on the shaft and the shaft is bent into a wave shape by the push from the eccentric cam. When the internal shaft bends, the upper bearings, including cantilever bearing 123, and main bearing 124, act as pivot points to centralize the shaft and the lower focal bearing 121 is spherical acting bearing assembly that acts as a fulcrum permitting the shaft to pivot the drill bit 126 in the opposite direction of the shaft deflection. In the embodiment of FIG. 1B, focal bearing 121 is formed from or includes a set of spherical rollers that are arranged substantially about a common center of rotation to permit drill bit 126 to tilt in a desired direction and to freely rotate.

Rotary steering system 101 has a driveshaft 110 that is supported by bearings 121, 122, 123 and 124 to housing 108. Further, rotary steering system 101 also includes electric clutch and gear reduction units (not shown) that impart rotation from shaft 110 to the nested eccentric rings 122 when needed to control the eccentricity of the eccentric cam acting on shaft 110 and shaft 110 is bent to a desired position resulting from the eccentric displacement. Additional descriptions of the deformation of shaft 110 and resultant friction moments are provided herein, and are illustrated in at least FIGS. 3A-3B. As shaft 110 is displaced relative to housing 108 at eccentric ring 122, deflection of shaft 110 causes focal bearing 121 to pivot to point drill bit 126 in a desired direction and desired tilt angle. Opposite and equal reaction forces are created between shaft 110 and housing 108 at bearing locations 121, 122, 123, and 124. In addition, an opposite and equal moment reaction is created between shaft 110 and housing 108 at focal bearing 121 due to frictional resistance to pivoting within the bearing. These reaction forces and moment cause deflection and angular displacement of shaft 110 and housing 108 within borehole 128. In addition, contact between borehole 128 and drill bit 126, stabilizers 112 and 114, and other locations of the BHA create reaction forces and moments that cause additional deflection and angular displacement of shaft 110 and housing 108 within borehole 128. These deflections and angular displacements may or may not cause stabilizers 112 and/or 114 to come into contact with borehole 128. Likewise housing 108 may or may not come into contact with borehole 128. Similarly, any part of the BHA including first section 102 and/or second section 106 may or may not come into contact with borehole 128. Drill bit 126 will be in contact with borehole 128 while drilling due to the application of weight on bit. Any such contact creates reaction forces and/or moments that cause deflection and angular displacement of the BHA as well as shaft 110 and housing 108 within borehole 128. When a balance state is achieved, the rotary steering system 101 is supported by borehole 128 at the resulting contact locations and drill bit 126 is pointed towards a desired direction at a desired tilt angle to create and to control dogleg severity of the wellbore as the wellbore is being drilled.

The steering direction estimation system considers shaft 110 and housing 108 as separate components when performing operations described herein to determine the bit steering tendency of a steering system, such as point-the-bit rotary steering system 101. More particularly, instead of treating housing 108 and shaft 110 as a single beam, housing 108 is treated as a first beam and shaft 110 is treated as a second beam that is nested within the first beam, thereby generating more accurate steering direction estimations. In some embodiments, where the interaction between the upper BHA 106 and borehole is analyzed, the upper BHA is also treated as a component of the first beam. Additional descriptions of performing a nested beam analysis are provided herein.

Although FIG. 1B illustrates shaft 110 coming into contact with focal bearing 121, eccentric ring 122, cantilever bearing 123, and main bearing 124, in some embodiments, shaft deflection occurs at contact points about additional bearings, or other components of housing 108. Similarly, although FIG. 1B illustrate two stabilizers 112 and 114, in some embodiments, a different number of stabilizers are positioned around housing 108, and other sections of point-the-bit rotary steering system 101. Further, although FIG. 1B illustrates the upper BHA 106 that is coupled to first section 102, in some embodiments, bottomhole assembly 100 includes additional sections which are analyzed by the steering direction estimation system and taken into account to determine the shaft deflection of the shaft and housing deflection of the housing, and to estimate the steering tendency of point-the-bit rotary steering system 101.

Figure 2A:
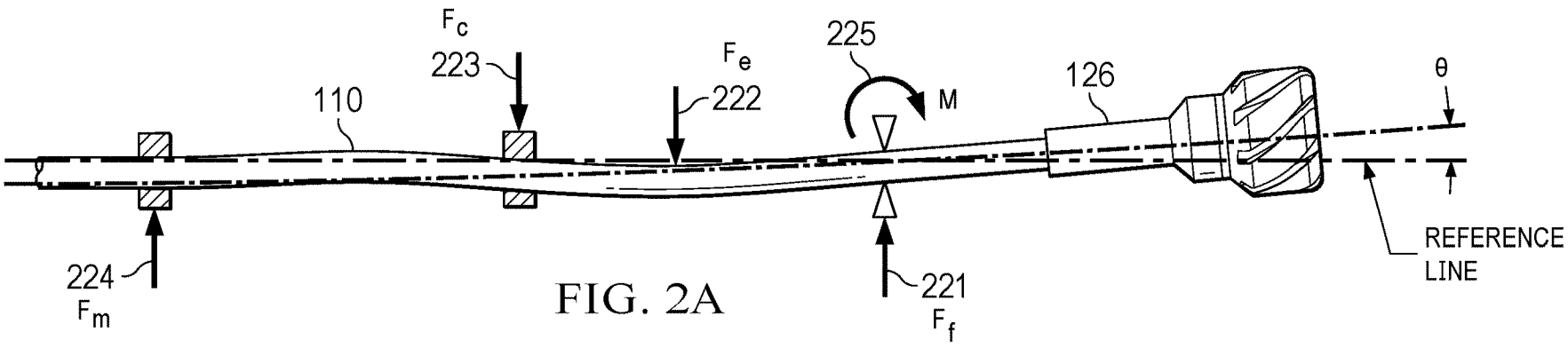
FIG. 2A is an illustration of a shaft component of the point-the-bit rotary steering system of FIG. 1B, where forces or moments are exerted at four points.
Figure 2B:
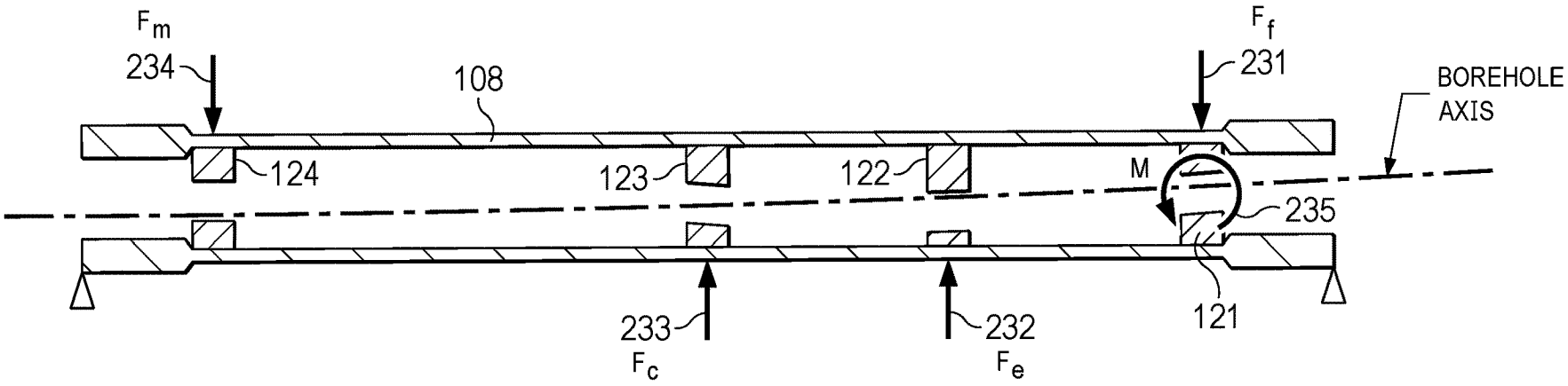
FIG. 2B is an illustration of a housing component of the point-the-bit rotary steering system of FIG. 2A, where forces or moments are exerted at four points.

FIG. 2A is an illustration of shaft 110 of a point-the-bit rotary steering system 101 of FIG. 1B, where forces or moments are exerted at four points. More particularly, forces Fr 221, Fe 222, Fc 223, and Fm 224, and moment M 225 are exerted at contact points along focal bearing 121, eccentric ring 122, cantilever bearing 123, main bearing 124, and focal bearing 121, respectively. FIG. 2B is an illustration of housing 108 of rotary steering system 101, where forces or moments are exerted at four points. More particularly, forces Fr 231, Fe 232, Fc 233, and Fm 234, and moment M 235 are exerted at contact points along focal bearing 121, eccentric ring 122, cantilever bearing 123, main bearing 124, and focal bearing 121, respectively. In the embodiment of FIGS. 2A and 2B, housing 108 and shaft 110 are treated as two separate beams. Further, the friction moment is represented as a bending moment, M (as explained in the paragraphs below), and housing 108 and shaft 110 are assumed to have the identical deflection at all bearing points.

Housing 108 is analyzed to determine the deflection and constraints to housing 108 due to borehole 128. More particularly, force applied to stabilizers 112 and 114 is analyzed to determine the deflection or deformation to housing 108 as a result of contact with borehole 128. In some embodiments, the steering direction estimation system utilizes an Euler-Bernoulli beam theory to determine the deformation to housing 108, and the shear force/moment applied to points of contact between stabilizers 112 and 114 and borehole. In some embodiments, one or more interactions between housing 108 and borehole 128 are determined based on the deflection of housing 108. In some embodiments, one or more constraints to housing 108 within borehole 128 are applied to determine the housing deflection of housing 208.

Figure 3A:
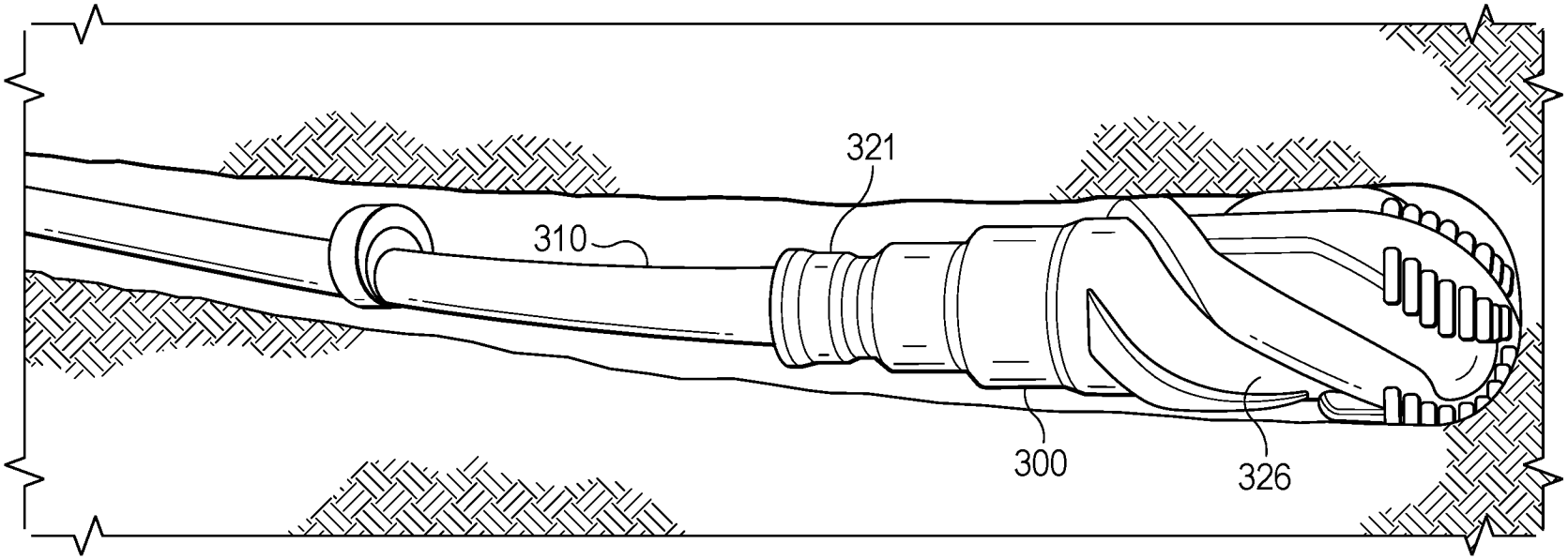
FIG. 3A is a rendering of a focal bearing of a point-the-bit rotary steering system.

FIG. 3A is a rendering of a focal bearing 321 of a point-the-bit rotary steering system 300. In the embodiment of FIG. 3, focal bearing 321 is formed from or includes a set of spherical rollers that are arranged substantially about a common center of rotation to permit a drill bit 326 to tilt in a desired direction and to freely rotate. When a shaft 310 bends, the upper bearings (not shown) act as pivot points to centralize shaft 310 and the lower focal bearing 321 acts like a fulcrum permitting shaft 310 to pivot drill bit 326 in a direction opposite the direction of the shaft deflection of shaft 310. In some embodiments, focal bearing 321 is preloaded to prevent the spherical thrust bearings from separating when subjected to large radial load in the absence of a large axial load. Friction at the preloaded focal bearings reacts some or all of the moment created by bit side force into the non-rotating housing. As a result, the tool is effectively stiffer than expected and this frictional moment at focal bearing 321 is less when shaft 310 is rotating. This friction moment at focal bearing 321 is included in an equivalent bending spring which is proportional to local angle change.

Figure 3B:
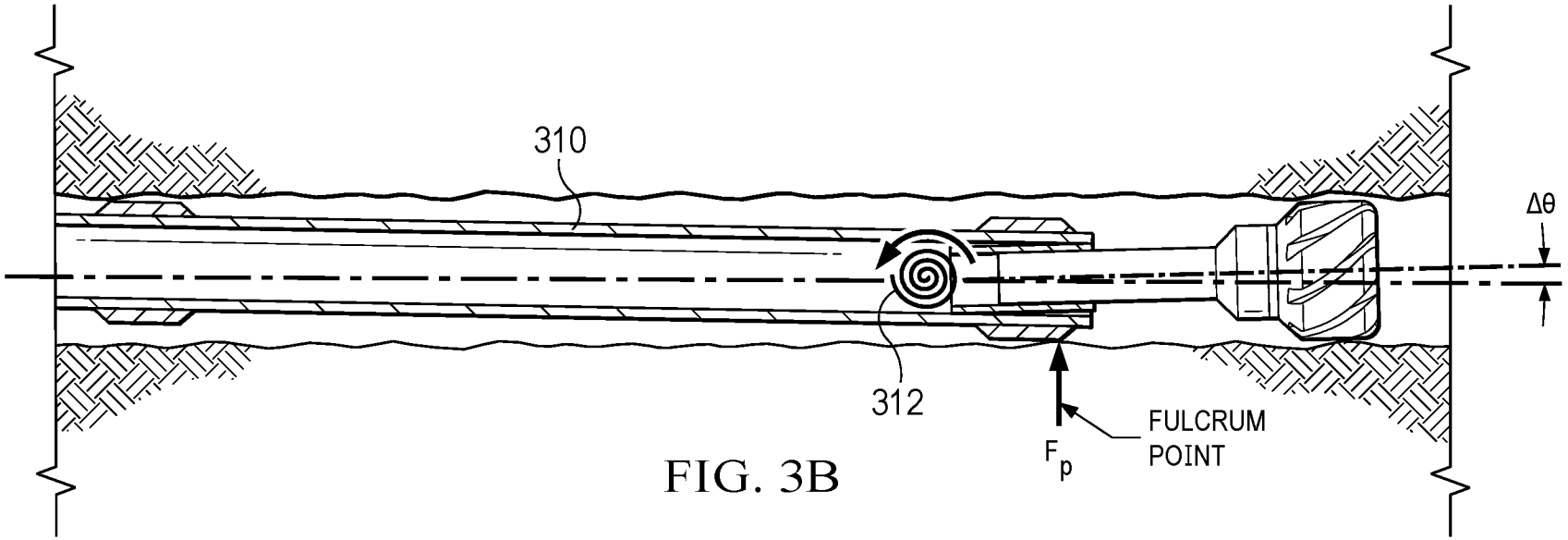
FIG. 3B is an illustration of a proposed equivalent spring at focal bearing to simulate the resultant friction moment.

In that regard, FIG. 3B is an illustration of a proposed equivalent spring 312 at focal bearing 321 of FIG. 3A to simulate the resultant friction moment. The friction moment at the focal bearing is lumped into equivalent bending spring 312, which imposes a local kink to the bottomhole assembly as:

$$M = k\theta \qquad \text{Equation (1)}$$

where M is the applied frictional moment and θ is the local tilt angle of the shaft at the location of focal bearing 321. k designates the rigidity of the equivalent spring. In some embodiments, the steering direction estimation system applies a finite-element algorithm to quantify and/or investigate the unexpected stiffening behavior of focal bearing and further to study the interactions between the borehole and BHA.

Figure 4A:
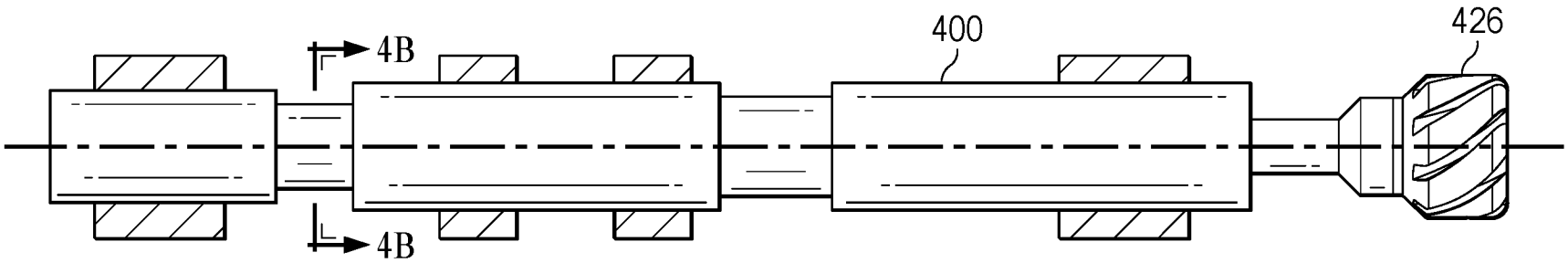
FIG. 4A is an illustration of a bottomhole assembly geometry.
Figure 4B:
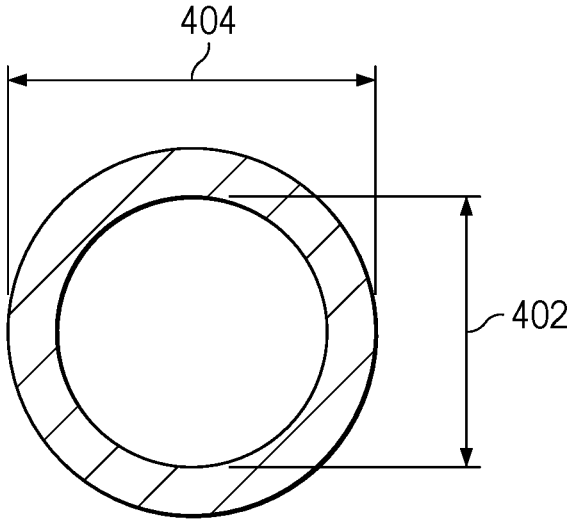
FIG. 4B is an illustration of a cross-section of a discretized segment of bottomhole assembly.
Figure 4C:
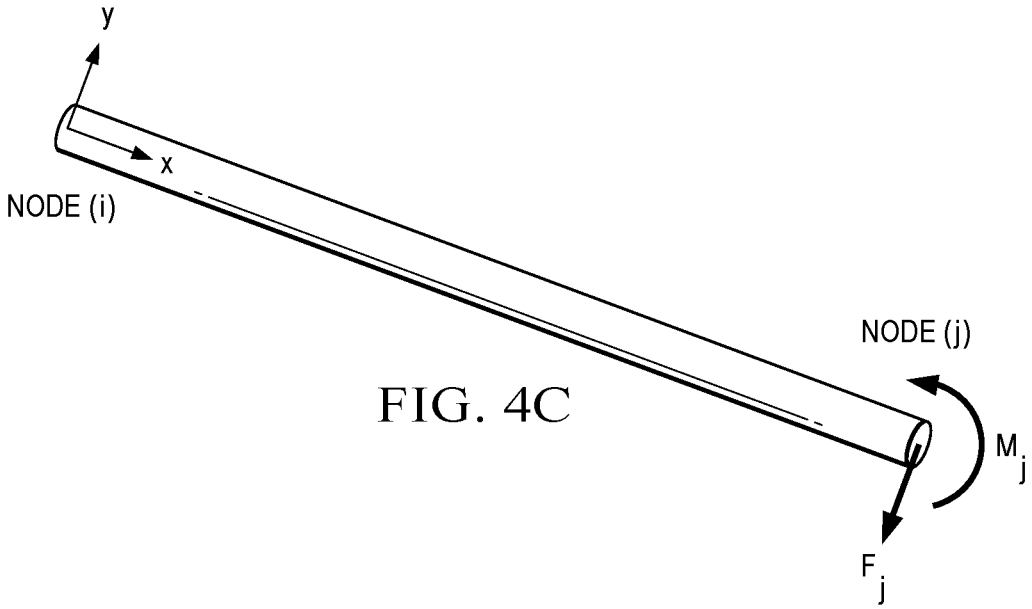
FIG. 4C illustrates a nodal lateral force and a moment applied to a discretized segment of bottomhole assembly.

FIG. 4A is an illustration of a bottomhole assembly geometry of a bottomhole assembly 400. FIG. 4B is an illustration of a cross-section for a selected discretized segment of bottomhole assembly 400 having an inner diameter 402 and an outer diameter 404. FIG. 4C illustrates a nodal lateral force and a moment applied to a discretized segment of bottomhole assembly 400. In the embodiment of FIGS. 4A-4C, the borehole radius of curvature is large compared to characteristic length, and bottomhole assembly 400 is approximated by Euler-Bernoulli beam. The force and moment at drill bit 426 are obtained according to a linear model as functions of loads acting on bottomhole assembly 400.

In the embodiment of FIGS. 4A-4C, the steering direction estimation system applies an algorithm that is a piecewise approximation, where a complicated problem is subdivided into lesser complex divisions and solved. More particularly, the steering direction estimation system reads inputs including the geometry and stiffness of bottomhole assembly 400, and subdivides the foregoing into discrete elements of constant cross-sectional geometry as illustrated in FIG. 4B. Further, for each of the elements a matrix of coefficient of influence is used to relate node lateral 10) force and moment to the general inputs as illustrated in FIG. 4C. The components of the lateral force and moment at bit 426 is expressed as linear combinations of the generalized loads applied on bottomhole assembly 400 as $$F_j = \left\{\mathcal{F}_{b_j}, \mathcal{F}_{w_j}, \mathcal{F}_{r_j}, \mathcal{F}_{\kappa_j}\right\}(\theta - \langle\Theta\rangle_1, \sin\langle\Theta\rangle_1, \Gamma, \kappa) \qquad \text{Equation (2)}$$

$$M_j = \left\{\mathcal{M}_{b_j}, \mathcal{M}_{w_j}, \mathcal{M}_{r_j}, \mathcal{M}_{\kappa_j}\right\}(\theta - \langle\Theta\rangle_1, \sin\langle\Theta\rangle_1, \Gamma, \kappa) \qquad \text{Equation (3)}$$

where $\theta - \langle\Theta\rangle_1$ is the relative orientation of the bit respective to undeformed bottomhole assembly, Γ is the actuation load, (force or kink), κ is the geometrical constraints imposed by the stabilizers that need to conform to the borehole geometry, and w sin $\langle\Theta\rangle_1$ is gravity resolved in the lateral direction of bottomhole assembly.

In some embodiments, an implementation of the (linear complementary programming (LCP) using bilateral constraints is used to calculate the contact conditions of selected potential contact pairs. In one or more of such embodiments, the clearance/contact forces for all nodes of the discretized elements are obtained based on the calculated results. In some embodiments, the steering direction estimation system also determines the side cutting force and bottomhole assembly, structural performance of inclination, stress and moments. In some embodiments, the steering direction estimation system generates numerical results that model the 3D static behavior characteristics of a bottomhole assembly. In some embodiments, the steering direction estimation system is further configured to analyze the static structural behavior resulting from most general combinations of bottomhole assembly, well configuration, and drilling parameters (e.g., weight-on-bit (WOB), actuation force, mud weight, etc.).

Figure 5:
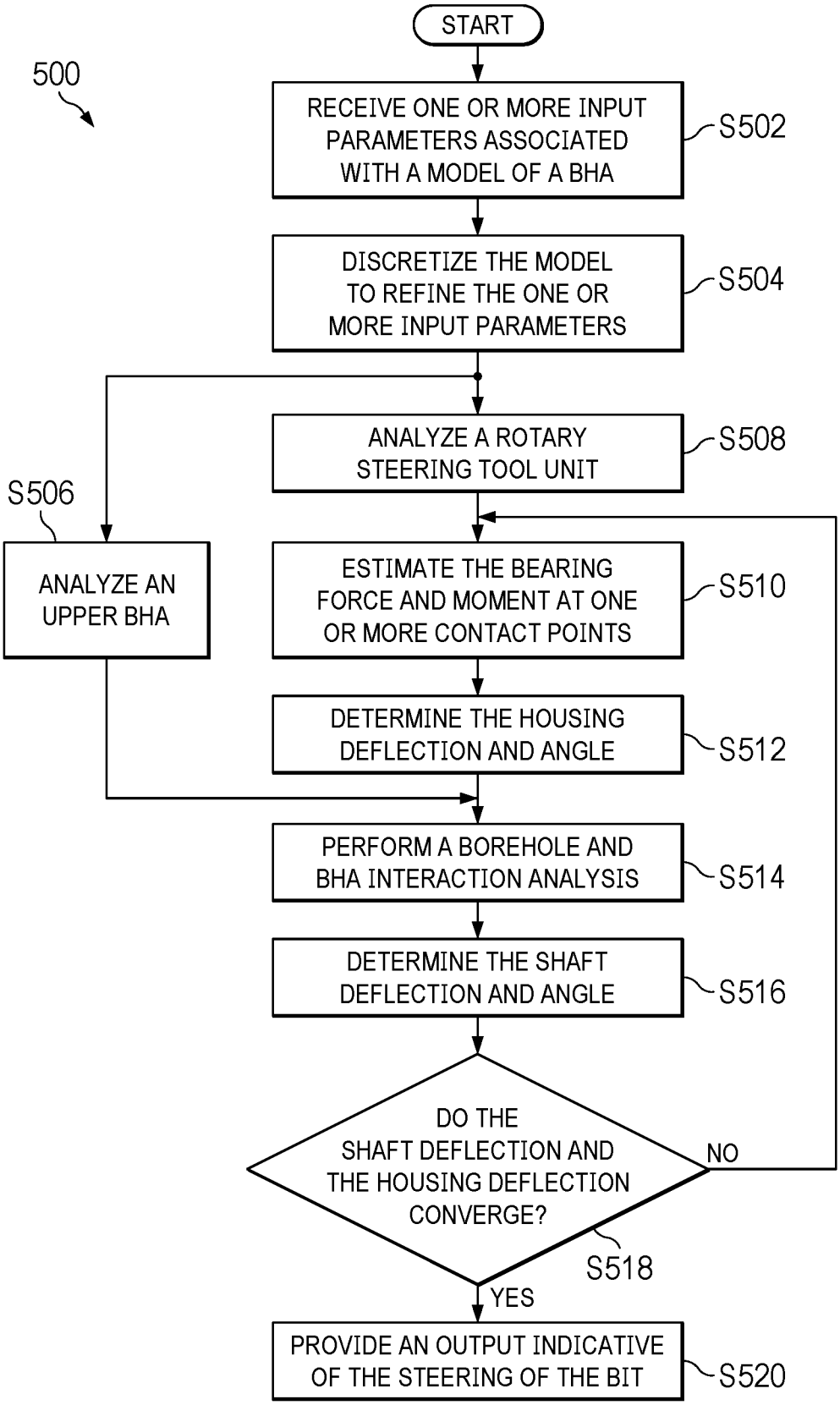
FIG. 5 is a flowchart of a process to determine of the steering of the bit with different bottomhole assemblies.

FIG. 5 is a flow chart of a process 500 to determine steering tendency of the bit. Although the operations in process 500 are shown in a particular sequence, certain operations may be performed in different sequences or at the same time where feasible.

At block S502, the steering direction estimation system receives one or more input parameters associated with a model of a BHA. Examples of input parameters include, but are not limited to, parameters associated with a steering system, parameters associated with a bottomhole assembly the steering system is coupled to, borehole constraints, parameters associated with a drill bit, and parameters associated with other components that are coupled to the bottomhole assembly or the steering system. FIG. 1B, for example, illustrates bottomhole assembly 100 with the point-the-bit rotary steering system 101 having a housing 108 and shaft 110.

At block S504, the model of the BHA is discretized to refine the input parameters. For example, the steering direction estimation system discretizes input parameters for calculating the housing deflection and the shaft deflection. In some embodiments, the steering direction estimation system applies an algorithm to further discretize the model of the BHA. At block S506, the steering direction estimation system analyzes an upper BHA that is coupled to the shaft. Sequentially or currently with block S506, the steering direction estimation system also analyzes the steering tool unit (a rotary steering unit for RSS or mud motor for steerable motor) at block S508. As described herein, the steering direction estimation system considers a housing of the rotary steering system as a first beam, and a shaft (and in some embodiments, the shaft together with the drill bit, and a portion of the upper BHA that is proximate to the shaft) as a second beam that is nested within the first beam. At block S510, the steering direction estimation system estimates the bearing force and moment at one or more contact points. At block S512, the steering direction estimation system determines the housing deflection and the angle of deflection of the housing based on the estimated bearing force and the moment at the contact points from block S510. In the embodiment of FIG. 1B, the contact points are points of focal bearing 121, eccentric ring 122, cantilever bearing 123, a main bearing 124, each positioned along an interior of housing 108. In some embodiments, the steering direction estimation system estimates the force and moment of housing 108 at the contact point of each bearing and eccentric ring (such as the focal bearing 121, the eccentric ring 122, the cantilever bearing 123, and the main bearing 124 of FIG. 1B) as vectors of $F_h$. The estimated force 30) and moment of housing 108 can be used to compute the housing deflection. In one or more of such embodiments, the steering direction estimation system determines the deflection of the housing at each bearing and eccentric ring (such as the focal bearing 121, the eccentric ring 122, the cantilever bearing 123, and the main bearing 124 of FIG. 1B) as vectors of $y_h$.

At block S514, the steering direction estimation system performs a borehole and BHA interaction analysis. In some embodiments, the steering direction estimation system solves a coefficient of influence matrix to perform the borehole and BHA interaction analysis. In some embodiments, the steering direction estimation system solves a linear complementary programming with additional force and moment to perform the borehole and BHA interaction analysis.

At block S516, the steering direction estimation system also determines a shaft deflection/angle of the shaft. In some embodiments, the steering direction estimation system assumes that the reaction forces and bending moments for the housing and shaft respectively are equal in magnitude and opposite in direction, and as such, the force vector for inner shaft beam is computed ($F_s=-F_h$). After the steering direction estimation system obtains the force vector of shaft beam, $F_s$, together with the external loads and borehole constraints, steering direction estimation system obtains the contact force and deflection/angle of the shaft beam by solving a complementarity problem as described herein. The steering direction estimation system also obtains the deflection/slope for the shaft beam at critical bearings and eccentric rings as the vector of $y_s$.

At block S518 the steering direction estimation system determines whether the shaft deflection and the housing deflection converge, where the shaft deflection is within a threshold of the housing deflection. In some embodiments, the steering direction estimation system determines whether the shaft deflection is within a threshold of the housing deflection at each of contact point where the shaft contacts the housing or another component (such as the focal bearing, eccentric ring, cantilever bearing, or another component positioned in the housing) that is positioned in the housing. In response to a determination that the shaft deflection is within the threshold of the housing deflection, the process proceeds to block S520, and the steering direction estimation system provides an output indicative of the steering tendency. The model of the BHA is an analytical model that is discretized by the steering direction estimation system to refine the input parameters for calculating the housing deflection, thereby reducing the duration of operations of process 500 from days to minutes, and drastically improving both the resource and hardware costs associated with obtaining steering direction estimations. In some embodiments, the steering direction estimation system provides the output for display on a display screen of an electronic device. In one or more of such embodiments, an operator provides additional inputs via the electronic device to modify one or more input parameters of the model of the BHA, and the steering direction estimation system performs the one or more operations of process 500 to provide a new output based on the modified input parameters.

Alternatively, the steering direction estimation system, in response to a determination that the shaft deflection is not within the threshold of the housing deflection, proceeds to block S510 to perform a second or subsequent estimation of the force and the moment at the contact point until the shaft deflection is within a threshold of the housing deflection. In some embodiments, the steering direction estimation system, in response to a determination that the deflection of the shaft is not within the threshold of the deflection of the housing, also modifies one or more input parameters associated with calculating the housing deflection of the housing or the shaft deflection of the shaft. In some embodiments, the steering direction estimation system, in response to a determination that the deflection of the shaft is not within the threshold of the deflection of the housing, performs one or more optimization operations to reduce a cost function associated with the deflection of the housing and the deflection of the shaft. In one or more of such embodiments, the steering direction estimation system applies a least square method to reduce or minimize the cost function to ensure the shaft and housing deformations are compatible, which results in the correct reaction forces and bending moments at the contact points. In one or more of such embodiments, the steering direction estimation system also specify and adjust set-ups of the optimization operation, such as apply different optimization algorithms and techniques, tune the algorithm parameters to fasten the converging process, monitor the convergency control the stopping criteria if necessary, etc., for calculating the housing deflection and the shaft deflection in successive iterations of process 500 until the shaft deflection is within a threshold of the housing deflection.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A computer-implemented method to determine steering of a bit, the method comprising:

receiving one or more input parameters associated with a model of a bottomhole assembly having a housing and a shaft that runs through an interior of the housing;

analyzing the housing as a first beam;

analyzing the shaft as a second beam that is nested within the first beam;

estimating a force and a friction moment at one or more contact points between the shaft and the housing and along an upper bottomhole assembly that is coupled to the shaft as another component of the second beam;

determining a housing deflection based on the force and the friction moment at the one or more contact points between the housing and the shaft, wherein the upper bottomhole assembly and the housing are constrained by a borehole geometry;

determining a shaft deflection at the one or more contact points;

determining whether the shaft deflection is within a threshold of the housing deflection; and steering the bit using the determination that the shaft deflection is within the threshold of the housing deflection.

2. The computer-implemented method of claim 1, further comprising discretizing the model to refine the one or more input parameters for estimating the force and the friction moment at the one or more contact points.

3. The computer-implemented method of claim 1, further comprising:

determining an angle of deflection of the housing based on the force and the friction moment at the one or more contact points;

determining an angle of the shaft deflection at the one or more contact points;

determining whether the angle of the shaft deflection is within a threshold of the angle of the housing deflection; and in response to a determination that the angle of the shaft deflection is within the threshold of the angle of the housing deflection, providing an output indicative of the steering of the bit.

4. The computer-implemented method of claim 1, wherein determining the housing deflection along the housing comprises determining the housing deflection along the housing based on the force and the friction moment at a focal bearing that is positioned within the housing, and wherein a first contact point of the one or more contact points is at the focal bearing.

5. The computer-implemented method of claim 4, further comprising:

determining a force and a friction moment at a second contact point between the shaft and the housing, wherein determining the housing deflection along the housing comprises determining the housing deflection along the housing based on the force and the friction moment at the first contact point and the second contact point, and wherein the second contact point is at an eccentric ring that is positioned within the housing.

6. The computer-implemented method of claim 5, further comprising:

determining a force and a friction moment at a third contact point between the shaft and the housing, wherein determining the housing deflection along the housing comprises determining the housing deflection along the housing based on the force and the friction moment at the first contact point, the second contact point, and the third contact point, and wherein the third contact point is at a cantilever bearing that is positioned within the housing.

7. The computer-implemented method of claim 6, further comprising:

determining a force and a friction moment at a fourth contact point between the shaft and the housing, wherein determining the housing deflection along the housing comprises determining the housing deflection along the housing based on the force and the friction moment at the first contact point, the second contact point, the third contact point, and the fourth contact point, and wherein the fourth contact point is at a main bearing that is positioned within the housing.

8. The computer-implemented method of claim 1, further comprising analyzing the bit that is coupled to the shaft as a component of the first beam.

9. The computer-implemented method of claim 8, further comprising analyzing the upper bottomhole assembly that is coupled to the shaft as another component of the first beam.

10. The computer-implemented method of claim 1, further comprising in response to a determination that the deflection of the shaft is not within the threshold of the deflection of the housing, performing a second estimation of the force and the friction moment at the one or more contact points.

11. The computer-implemented method of claim 10, further comprising in response to a determination that the deflection of the shaft is not within the threshold of the deflection of the housing modifying the one or more input parameters associated with calculating the housing deflection of the housing.

12. The computer-implemented method of claim 1, further comprising in response to a determination that the deflection of the shaft is not within the threshold of the deflection of the housing, performing an optimization operation to reduce a cost function associated with the deflection of the housing and the deflection of the shaft to reduce a variance between the deflection of the housing and the deflection of the shaft.

13. The computer-implemented method of claim 1, further comprising in response to a determination that the deflection of the shaft is not within the threshold of the deflection of the housing:

performing a second estimation of the force and the friction moment at the one or more contact points;

applying a yet-to-be applied optimization algorithm or technique; and tuning an algorithm parameter to fasten a converging process.

14. A system, comprising:

a storage medium; and one or more processors configured to:

receive one or more input parameters associated with a model of a bottomhole assembly having a housing and a shaft that runs through an interior of the housing;

analyze the housing as a first beam;

analyze the shaft as a second beam that is nested within the first beam;

estimate a force and a friction moment at one or more contact points between the shaft and the housing and along an upper bottomhole assembly that is coupled to the shaft as another component of the second beam;

determining a housing deflection based on the force and the friction moment at the one or more contact points between the housing and the shaft, wherein the upper bottomhole assembly and the housing are constrained by a borehole geometry;

determine a shaft deflection at the one or more contact points;

determine whether the shaft deflection is within a threshold of the housing deflection; and steer a bit using the determination that the shaft deflection is within the threshold of the housing deflection.

15. The system of claim 14, wherein the one or more processors are further configured to discretize the model to refine the one or more input parameters for estimating the force and the friction moment at the one or more contact points.

16. The system of claim 14, wherein the one or more processors are further configured to:

determine an angle of deflection of the housing based on the force and the friction moment at the one or more contact points;

determine an angle of the shaft deflection at the one or more contact points;

determine whether the angle of the shaft deflection is within a threshold of the angle of the housing deflection; and in response to a determination that the angle of the shaft deflection is within the threshold of the angle of the housing deflection, provide an output indicative of the steering of the bit.

17. The system of claim 14, wherein the one or more processors are further configured to:

in response to a determination that the deflection of the shaft is not within the threshold of the deflection of the housing, perform a second estimation of the force and the friction moment at the one or more contact points.

18. The system of claim 14, wherein the one or more processors are further configured to:

in response to a determination that the deflection of the shaft is not within the threshold of the deflection of the housing, perform an optimization operation to reduce a cost function associated with the deflection of the housing and the deflection of the shaft to reduce a variance between the deflection of the housing and the deflection of the shaft.

19. A non-transitory computer-readable medium comprising instructions, which, when executed by a processor, causes the processor to perform operations comprising:

receiving one or more input parameters associated with a model of a bottomhole assembly having a housing and a shaft that runs through an interior of the housing;

analyzing the housing as a first beam;

analyzing the shaft as a second beam that is nested within the first beam;

estimating a force and a friction moment at one or more contact points between the shaft and the housing and along an upper bottomhole assembly that is coupled to the shaft as another component of the second beam;

determining a housing deflection based on the force and the friction moment at the one or more contact points between the housing and the shaft, wherein the upper bottomhole assembly and the housing are constrained by a borehole geometry;

determining a shaft deflection at the one or more contact points;

determining whether the shaft deflection is within a threshold of the housing deflection; and steering a bit using the determination that the shaft deflection is within the threshold of the housing deflection.

20. The non-transitory computer-readable medium of claim 19 further comprising instructions, which, when executed by a processor, causes the processor to perform operations comprising in response to a determination that the deflection of the shaft is not within the threshold of the deflection of the housing, performing an optimization operation to reduce a cost function associated with the deflection of the housing and the deflection of the shaft to reduce a variance between the deflection of the housing and the deflection of the shaft.

* * * * *